US009073279B2

(12) United States Patent
Pettersson

(10) Patent No.: US 9,073,279 B2
(45) Date of Patent: Jul. 7, 2015

(54) MANUAL FEED BOX ERECTOR AND SEALER

(75) Inventor: Niklas Pettersson, Sandy, UT (US)

(73) Assignee: Packsize LLC, Salt Lake City, UT (US)

( * ) Notice: Subject to any disclaimer, the term of this patent is extended or adjusted under 35 U.S.C. 154(b) by 1059 days.

(21) Appl. No.: 13/129,098

(22) PCT Filed: Nov. 23, 2009

(86) PCT No.: PCT/US2009/065552

§ 371 (c)(1),
(2), (4) Date: Oct. 3, 2011

(87) PCT Pub. No.: WO2010/060047

PCT Pub. Date: May 27, 2010

(65) Prior Publication Data

US 2012/0011814 A1 Jan. 19, 2012

Related U.S. Application Data

(60) Provisional application No. 61/117,533, filed on Nov. 24, 2008.

(51) Int. Cl.

| | |
|---|---|
| ***B65B 43/26*** | (2006.01) |
| ***B31B 1/60*** | (2006.01) |
| ***B65B 43/54*** | (2006.01) |

(52) U.S. Cl.

CPC . *B31B 1/60* (2013.01); *B65B 43/26* (2013.01); *B31B 2201/283* (2013.01); *B31B 2201/295* (2013.01); *B31B 2201/60* (2013.01); *B31B 2203/003* (2013.01); *B65B 43/265* (2013.01); *B65B 43/54* (2013.01)

(58) Field of Classification Search

USPC ..... 53/242, 284, 467, 491, 376.3, 376.4, 53/376.5, 376.7, 377.2, 378.3, 377.4; 493/70, 80, 268

IPC ..... B65B 7/20,7/2864; B31B 1/60, 2201/283, B31B 2201/295

See application file for complete search history.

(56) References Cited

U.S. PATENT DOCUMENTS 3,143,937 A 8/1964 Martin
3,466,843 A * 9/1969 Mumper ..... 53/136.4

(Continued)

FOREIGN PATENT DOCUMENTS

WO 2010060047 5/2010

OTHER PUBLICATIONS

International Search Report and Written Opinion for PCT/US2009/065552 dated Jan. 21, 2010.

*Primary Examiner* — Christopher Harmon
(74) *Attorney, Agent, or Firm* — Workman Nydegger

(57) ABSTRACT

A closure device including a closure assembly for closing the flaps of a box. The closure assembly includes a T-shaped structure having a first horizontal surface upon which a box can move during a closure process and a guide positioned on each side of the T-shaped structure, each guide being angled relative to the T-shaped structure and adapted to close the major flaps of the box as the box is moved proximally across the T-shaped structure. The horizontal portion can be positioned vertically higher than a support surface to allow a portion of the box to move therebetween. The closure device can further include a minor flap closure device for closing the minor flaps of the box prior to closing the major flaps of the box. The closure device can also include a sealing device, such as a taping head, for sealing the box closed.

36 Claims, 10 Drawing Sheets

(56) References Cited

U.S. PATENT DOCUMENTS

| | | | | | |
|---|---|---|---|---|---|
| 3,690,222 | A | | 9/1972 | Schroeder | |
| 3,915,786 | A | | 10/1975 | Collett et al. | |
| 3,948,152 | A | | 4/1976 | Nolan et al. | |
| 3,954,550 | A | | 5/1976 | Patterson | |
| 3,959,950 | A | * | 6/1976 | Fukuda | 53/467 |
| 4,238,269 | A | | 12/1980 | Deering, Jr. | |
| 4,398,381 | A | * | 8/1983 | Ulrich et al. | 53/393 |
| 4,522,016 | A | | 6/1985 | DiRico | |
| 4,570,421 | A | * | 2/1986 | Focke et al. | 53/491 |
| 5,115,625 | A | * | 5/1992 | Barbulesco et al. | 53/467 |
| 5,321,936 | A | * | 6/1994 | Sendldorfer | 53/491 |
| 5,374,326 | A | | 12/1994 | Marchetti | |
| 5,454,776 | A | * | 10/1995 | Ulrich et al. | 493/117 |
| 5,486,152 | A | * | 1/1996 | Heinz et al. | 493/468 |
| 5,626,708 | A | | 5/1997 | Vasilakes et al. | |
| 5,782,064 | A | * | 7/1998 | Beeman | 53/467 |

* cited by examiner

MANUAL FEED BOX ERECTOR AND SEALER

CROSS-REFERENCE TO RELATED APPLICATIONS

This application claims the benefit of, and priority to, U.S. Provisional Patent Application Ser. No. 61/117,533, filed on 24 Nov. 2008, and entitled "MANUAL FEED BOX ERECTOR AND SEALER," the entirety of which is incorporated herein by reference.

BACKGROUND OF THE INVENTION

1. Technical Field

Exemplary embodiments of the invention relate to the manufacture and construction of packaging materials. More particularly, embodiments relate to a device for erecting and sealing packaging materials, such as packaging formed of corrugated board.

2. The Relevant Technology

Manufacturers and suppliers of products often package their products in shipping containers before sending products to their customers. Each shipping container may accommodate either a single product or multiple products, depending on the application. Moreover, the container allows for ease in handling, shipping, and storing the products, along with providing protection from damage, theft, and contamination.

Although many types of shipping containers and container materials are readily available on the market, one of the most common shipping containers is a corrugated cardboard container or box. Boxes are typically both economical and sufficiently strong for most shipping uses and come in many shapes and sizes. Included in the known type of boxes to which the present invention can be applied is the regular slotted carton.

A regular slotted carton is generally rectangular and includes four contiguous vertical side surfaces and two pairs of flaps, commonly known as the major and minor pairs of flaps, on both the top and bottom of the box. Each of the flaps is connected to one of the vertical side surfaces, such that when the pairs of minor and major flaps are folded toward each other and toward the center of the box, the edges of at least the major flaps meet near the center of the top or bottom of the box, effectively creating the top and bottom horizontal surfaces of the box and closing the box. The flaps on the regular slotted carton are typically sealed in place by glue or by tape.

BRIEF SUMMARY OF THE INVENTION

Exemplary embodiments of the invention relate to the manufacture and construction of packaging materials. More particularly, embodiments relate to a device for erecting and sealing packaging materials, such as packaging formed of corrugated board.

According to one embodiment of the present invention, a closure device for closing major flaps of a box includes a closure assembly. In one aspect, the closure assembly includes a T-shaped structure having a distal end, a proximal end, and first horizontal surface upon which a box can move during a closure process. The closure assembly further includes, a guide positioned on each side of the T-shaped structure, each guide being angled relative to the T-shaped structure and adapted to close the major flaps of the box as the box is moved proximally across the T-shaped structure.

In one embodiment, the closure device can further include a support structure with a support surface upon which a box can be moved. In one aspect, the support structure is a table. In one aspect, the first horizontal surface is positioned vertically higher than the support surface to allow a portion of a box to move therebetween.

In some embodiments, the closure assembly includes a minor flap closure device. The minor flap closure device can include a notched portion or an upwardly extending portion to facilitate the folding of the minor flaps of a box. The closure device can also include an advancement mechanism to facilitate alignment and movement of the box on the support surface. In some embodiments, the closure device further includes a sealing device, such as a tape head, for securing the box flaps in a closed position.

In one embodiment, a method for closing and sealing at least one end of a box is disclosed. In one aspect, the method includes providing a closure device, providing a box that includes at least a pair of bottom minor flaps and a pair of bottom major flaps, folding the bottom minor flaps to a closed position, moving the box across the first horizontal surface of the T-shaped structure so that bottom major flaps of the box are folded to a closed position by the guides, and moving the box across a sealing device associated with the T-shaped structure to apply a sealant to the bottom major flaps and/or the sides of the box to secure the bottom major flaps in the closed position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The embodiments described herein extend to methods, devices, systems, assemblies, and apparatus for erecting, closing, and sealing objects. Such are configured to, for example, reliably close and seal objects in a simplified manner.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present invention. It will be obvious, however, to one of ordinary skill in the art that the present invention may be practiced without these specific details. In other cases, well known aspects of closing and sealing objects, general manufacturing techniques, and packaging products are not described in detail herein in order to avoid unnecessarily obscuring the novel aspects of the present invention.

FIGS. 1-8E and the following discussion are intended to provide a brief general description of exemplary devices in which embodiments of the invention may be implemented. While closure devices for erecting, closing, and sealing packaging are described below, these are but a few examples, and embodiments of the invention may be implemented with other types of closable objects. Accordingly, throughout the specification and claims, the phrases "closable object," "closable item," and the like are intended to apply broadly to any type of item that can be closed and sealed with a system or device as described herein.

The Figures thus illustrate various examples of suitable closure devices implementing some aspects of the present invention. The closure devices in the Figures are only examples of suitable devices/systems and are not intended to suggest any limitation as to the scope of use or functionality of an embodiment of the invention. Neither should the devices/systems be interpreted as having any dependency or requirement relating to any one or combination of components illustrated in the systems/devices.

Figure 1:
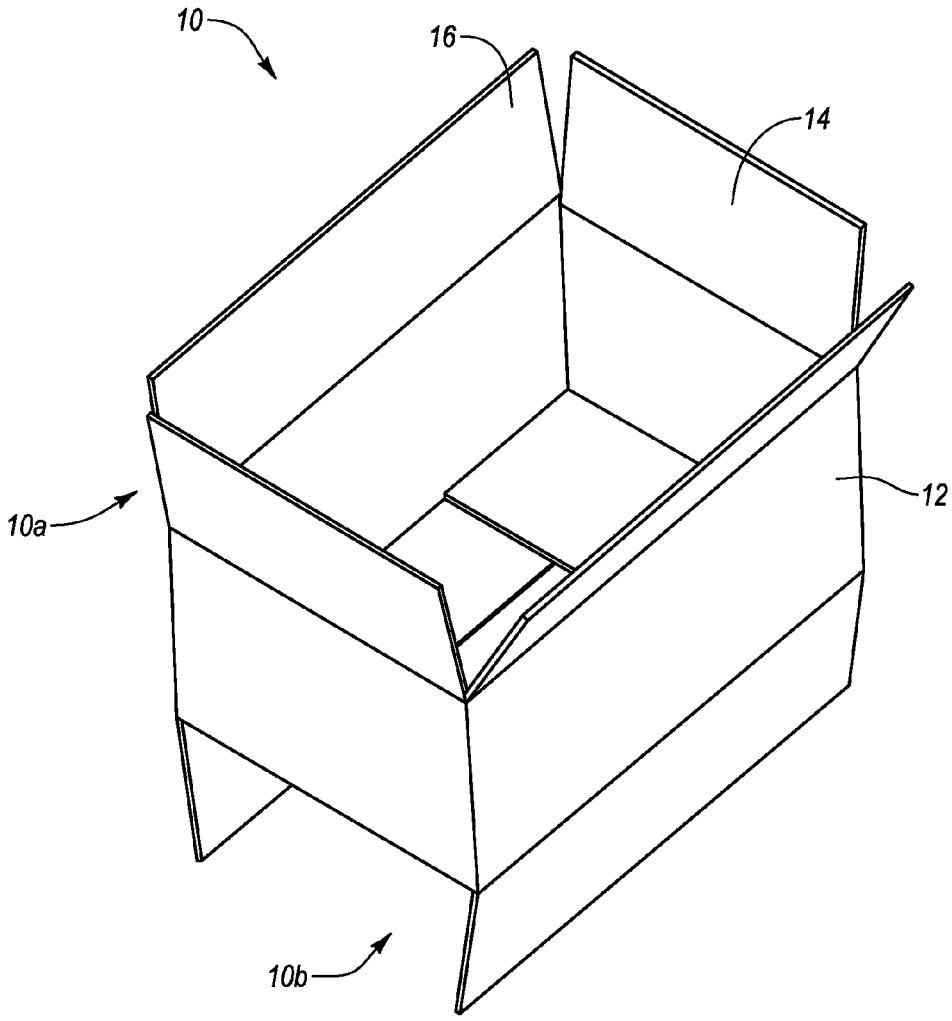
FIG. 1 illustrates a corrugated box that can be closed and sealed with any of the closure devices described herein.

With reference to FIG. 1, an example of a slotted carton 10 is illustrated. The slotted carton 10 is generally rectangular and includes four contiguous vertical side surfaces 12 and two pairs of flaps 14 and 16, commonly known as the minor 14 and major 16 pairs of flaps, on both the top 10*a* and bottom 10*b* of the box. Each of the flaps 14 and 16 is connected to one of the vertical side surfaces 12.

In one example, a box blank that can be used to form the box 10 may be formed from a roll or fanfold of corrugated board. A typical machine may, for example, take an initial roll or fanfold of corrugated board and cut the board into a desired shape and design that includes cuts, scores, perforations, creases, or other features. To ease shipment and storage of the packaging materials, it has been found useful to stack the packaging until such time as it is needed for use or for shipment to an end-user.

A box blank may be formed into a box (e.g., box 10) by folding the blank and joining (e.g., by taping or gluing) the vertical side surfaces 12 together to form the box shape illustrate in FIG. 1. The bottom 10*b* and top 10*a* surfaces are formed by folding the pairs of minor flaps 14 and major flaps 16 toward each other and toward the center of the box 10 and taping or gluing the edges of the major flaps 16 together, effectively creating the top and bottom horizontal surfaces of the box 10 and closing the box 10.

The flaps 14 and 16 on the regular slotted carton 10 are typically sealed in place by glue or by tape. For example, glue can be a applied to the minor flaps 14 in regions that adjoin the major flaps 16 when the major flaps 16 are folded onto the minor flaps 14. In the case of taping, the tape is often applied to the outside of the box 10 in either a "C-clip" or an "L-clip" configuration, both of which are commonly known in the art and are described below.

The C-clip is so named because a cross-section of the tape is in the shape of the letter "C." More specifically, a C-clip of tape is a continuous length of adhesive tape that is applied to a portion of one vertical side of a box, across the center of one of the horizontal surfaces of the box to seal the abutting major flaps together, and finally to a portion of the opposite vertical side of the box. Moreover, the tape for a C-clip is typically wide enough to be applied along the abutting flaps such that each of the major pairs of flaps on the top and bottom of the box can be sealed by a single piece of tape. When the regular slotted carton is closed and sealed with a C-clip of adhesive tape, there are no substantial gaps to allow contaminants to reach the product or products enclosed in the box.

The L-clip is so named because a cross-section of the tape is in the shape of the capital letter "L." More specifically, an L-clip of adhesive tape comprises a length of adhesive tape that is applied to a portion of one vertical side of the box and to an adjacent portion of one of the horizontal surfaces of the box, effectively securing one or both of the abutting flaps of the horizontal surface to the vertical side of the box. The number of L-clips applied to a single box can vary based on the manufacturer's or supplier's requirements for the integrity of the box in its sealed condition.

The general application of single lengths of box sealing tape to boxes in a C-clip, L-clip, or other configuration by various apparatuses such as hand-held devices and automatic and semi-automatic box sealing machines is well known. However, to close and seal a box using a hand-held device requires an individual first to fold and maintain the minor flaps in position while the major flaps are folded into position. The individual must continue to maintain the flaps in the closed position with one hand while using the other hand to grasp the hand-held device and apply tape or other sealer to the flaps. This process can be cumbersome and lead to boxes being ineffectively closed and/or sealed. While many of the automatic and semi-automatic box sealing machines are less cumbersome than hand-held devices, these more sophisticated machines are often complex to use and expensive to manufacture and maintain.

Figure 2:
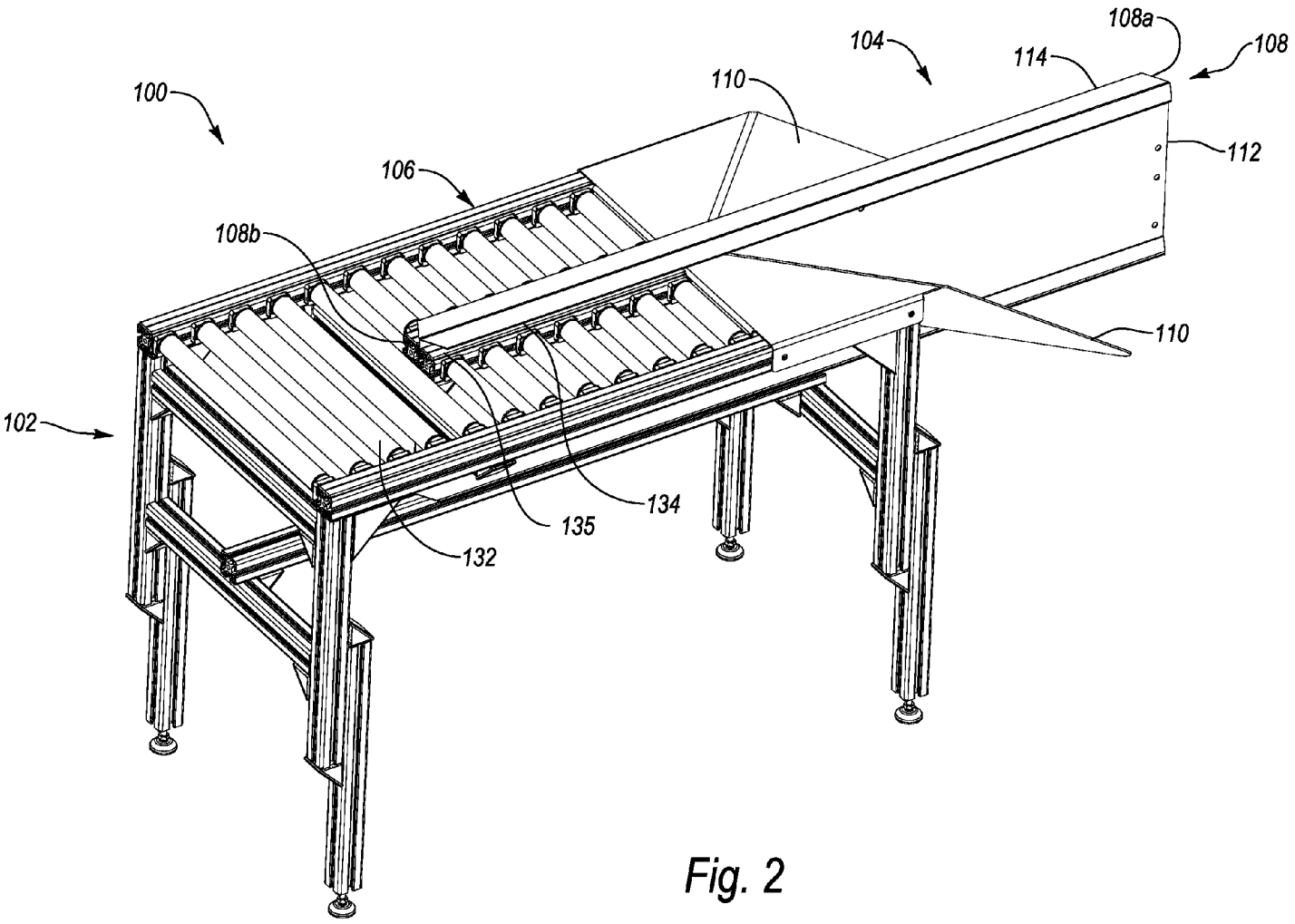
FIG. 2 illustrates an exemplary closure device according to some aspects of the present invention for use in closing a corrugated box.
Figure 3:
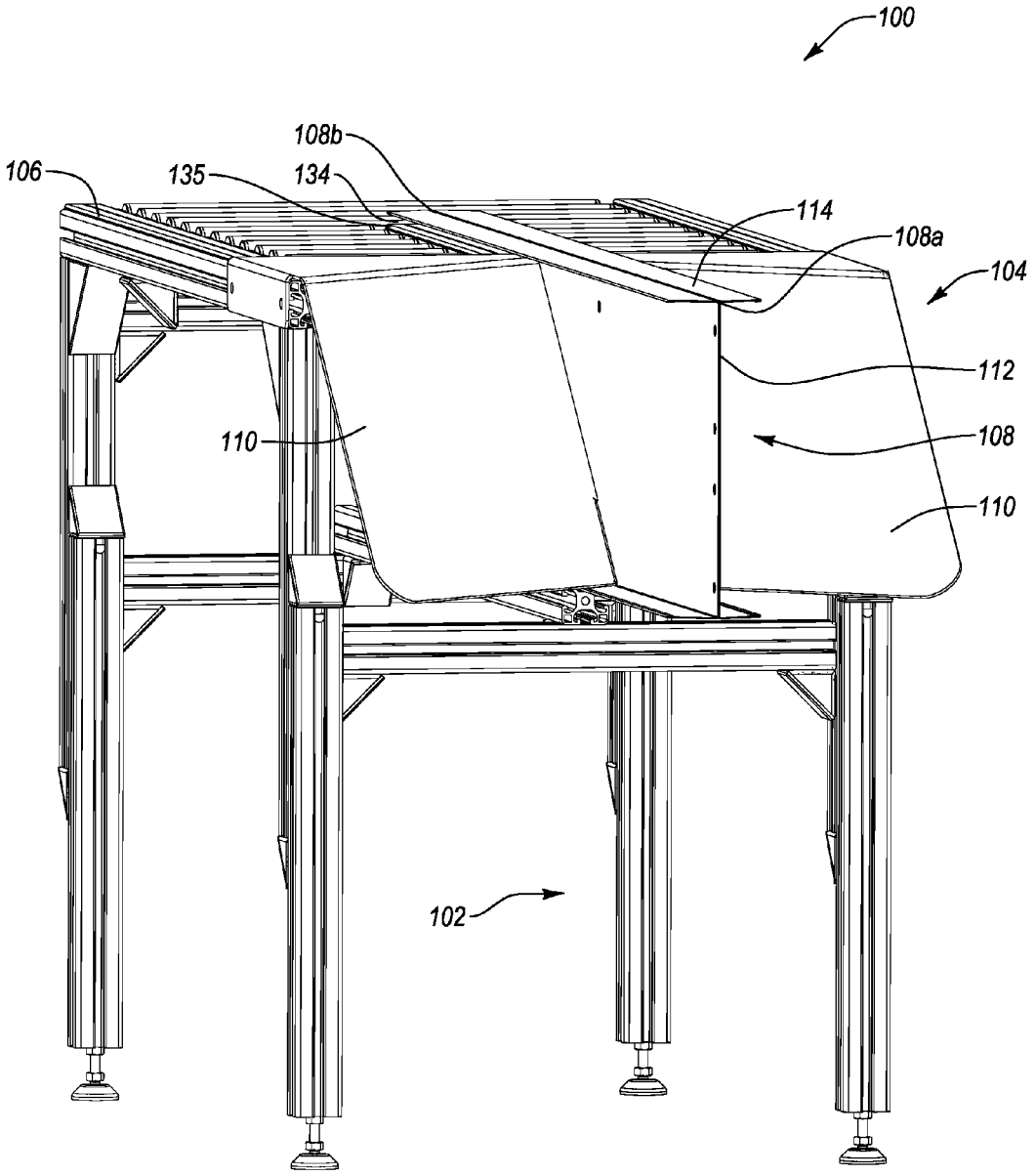
FIG. 3 illustrates another view of the closure device of FIG. 2.

With reference now to FIGS. 2 and 3, views of an exemplary closure device 100 for closing major flaps of a box are broadly illustrated. The closure device 100 includes a support structure 102 and a closure assembly 104 which facilitates the ready and convenient erecting and closing of packaging materials. The support structure 102 includes a support surface 106 upon which the packaging material can be moved during a filling and/or sealing process. More specifically, the device 100 includes a table-type structure 102 having the closure assembly 104 extending therefrom. The closure assembly 104 may be configured to fold the minor flaps (FIG. 1, reference numeral 14) and major flaps (FIG. 1, reference numeral 16) of a corrugated box (FIG. 1, reference numeral 10) to a closed position. Alternatively, the minor flaps 14 may be folded by hand by an operator and the closure device 104 can be used to close the major flaps 16 of the corrugated box 10. With the flaps 14 and 16 in the closed position, the box 10 can be filled while positioned on the support surface 106. Once the box has been closed and filled, additional packaging material can be filled and closed in a similar manner with the device 100. Alternatively, the bottom 10*b* of the box 10 can be sealed using a taping or gluing device coupled to the support surface 106. In such a situation, the box 10 can subsequently be filled and the top 10*a* of the box 10 can be sealed.

The closure assembly 104 includes a T-shaped structure 108 and a guide plate or folding guide 110 on each side of the T-shaped structure 108. The T-shaped structure 108 has a distal end 108*a* and a proximal end 108*b*. The vertical portion 112 of the T-shaped structure 108 is attached to, mounted on, or otherwise joined to the frame 102 of the closure device 100. The T-shaped structure 108 includes a first horizontal surface 114 upon which a box can move during a closure process. The first horizontal surface 114 of the T-shaped structure 108 is oriented generally parallel to the top surface of the support structure 102. The T-shaped structure 108 of the closure assembly 104 may further include a second horizontal surface 135 spaced apart and below the first horizontal surface 114. As seen in the illustrated embodiment, the T-shaped structure 108 can extend into the frame 102 as will be described in greater detail below.

Figure 8A:
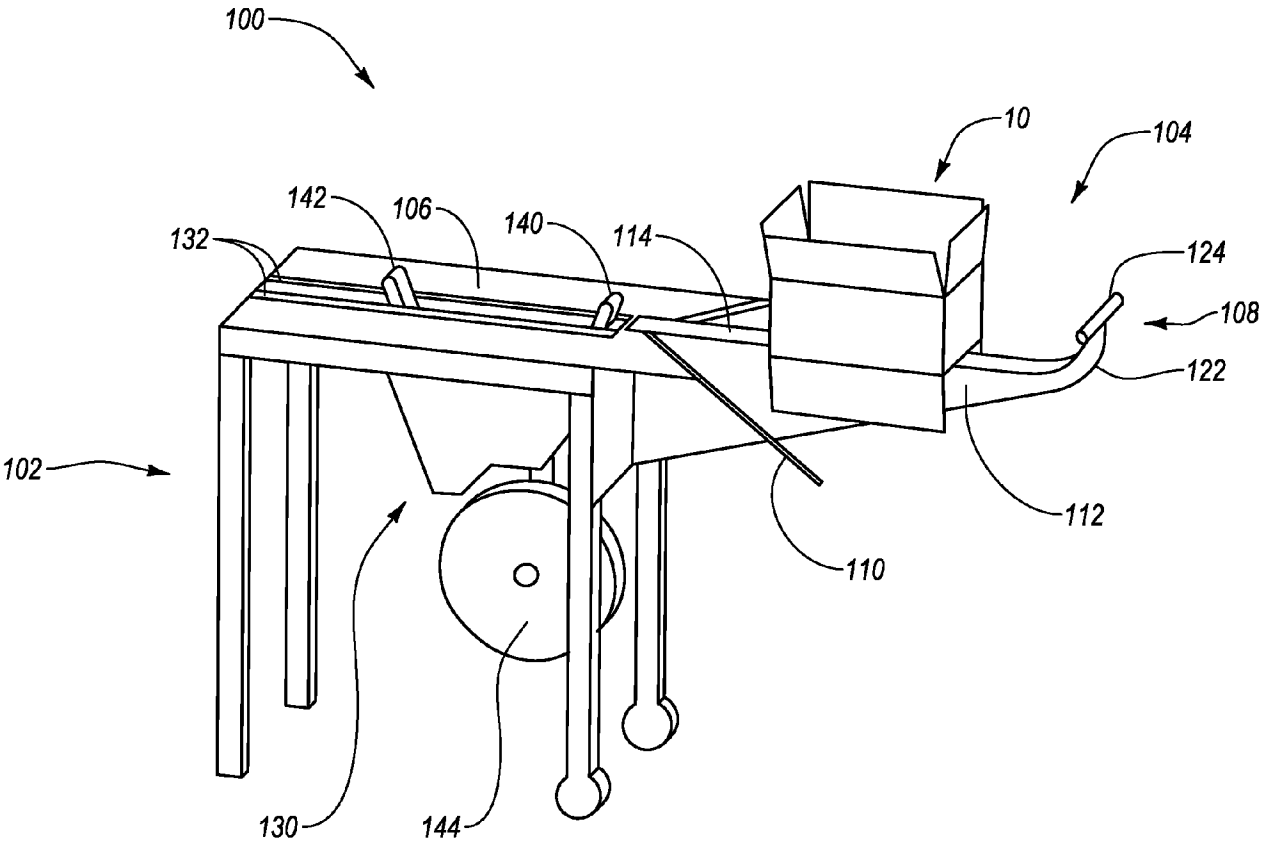
FIGS. 8A-8E illustrate another exemplary closure device according to some aspects of the present invention for use in closing and sealing a corrugated box with a corrugated box at various positions during the closing and sealing process.
Figure 8B:
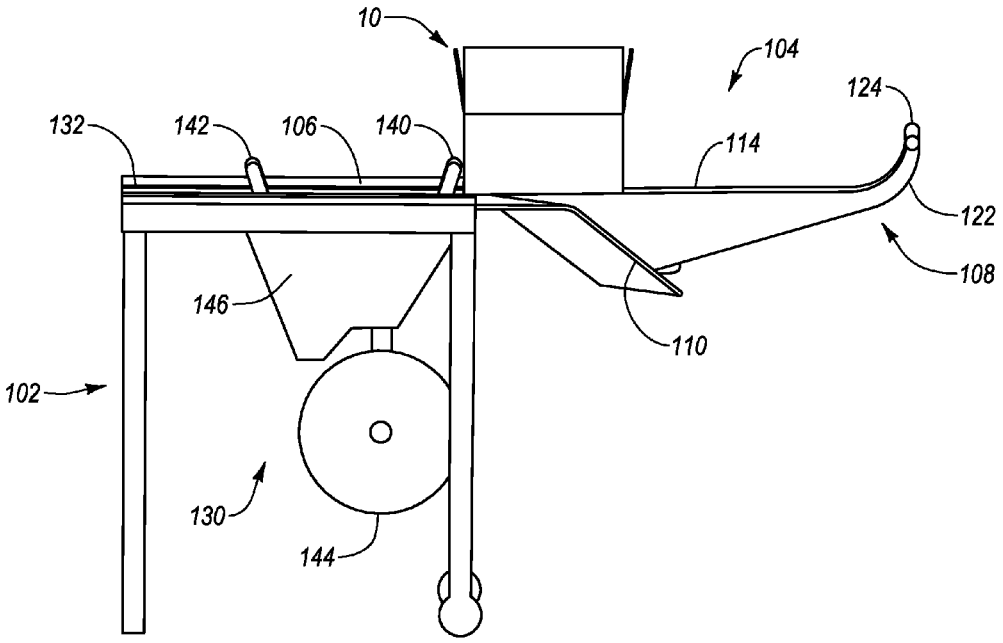

As noted, the closure assembly 104 illustrated in FIGS. 1 and 2 includes major flap folding guides 110 on the sides of the T-shaped structure 108. As can be seen in the Figures, the guides 110 are angled relative to the horizontal surface 114 and the vertical portion 112 of the T-shaped structure 108. This angled configuration of the guides 110 causes the major flaps to fold towards the center of the box as the box is moved along the T-shaped structure 108 towards the frame 102, as seen in FIGS. 8A-8B.

The guides 110 and the vertical portion 112 of the T-shaped structure 108 also assist in centering the box on the closure device 100. Specifically, as the box 10 is slid across the T-shaped structure 108 toward the support structure 102, the major flaps will engage the guides 110. If the box 10 is positioned further to one side of the device 100, the major flap on that side will engage the guide 110 first. The guide 110 (or guide 116 described below) will begin to fold the major flap closed. In addition, the guide 110 will also cause the box 10 to move in the direction of the other guide 110 until the forces experienced by both major flaps due to the guide plates are generally the same. Furthermore, if the box 10 is off center as the major flaps fold closed, one of the flaps will engage the vertical portion 112 of the T-shaped structure 108. As the major flaps are progressively folded closer to the bottom of the box, the engagement between the major flap and the vertical portion 112 will cause the box to move on the T-shaped structure 108 until the box 10 is centered thereon.

The guides 110 and the vertical portion 112 of the T-shaped structure 108 cooperate to center the box 10 on the device. This can be beneficial for a number of reasons. For example, when the device includes a sealing mechanism, such as a tape head as described below, it is helpful to have the box automatically centered with the sealing device without extra care by the user or additional devices, such as pneumatic arms that center the box on the device.

While the guides 110 in the above-referenced Figures are illustrated as having a particular angled orientation relative to the horizontal surface 114 and the T-shaped structure 108, it will be appreciated that the guides 110 can be oriented at a variety of angles as long as the guides 110 fold the major flaps towards the center of the box 10 as described herein. Similarly, it will be appreciated that the guides 110 can be mounted to the T-shaped structure 108, the frame 102 of the closure device 100, and/or the support surface 106 without departing from the scope of the invention.

It will also be appreciated that the guides can be arranged in a number of configurations without departing from the scope of the present invention. For example, FIGS. 2, 3, and 8A-8E illustrate guide plates 110 according to an embodiment of the present invention. The guide plates 110 are attached to the horizontal support surface 106 of the support structure 102. The guide plates 110 are generally configured as angled planar surfaces that extend toward the distal end 108*a* of the T-shaped structure 108 and are angled downward relative to the first horizontal surface 114.

Figure 4:
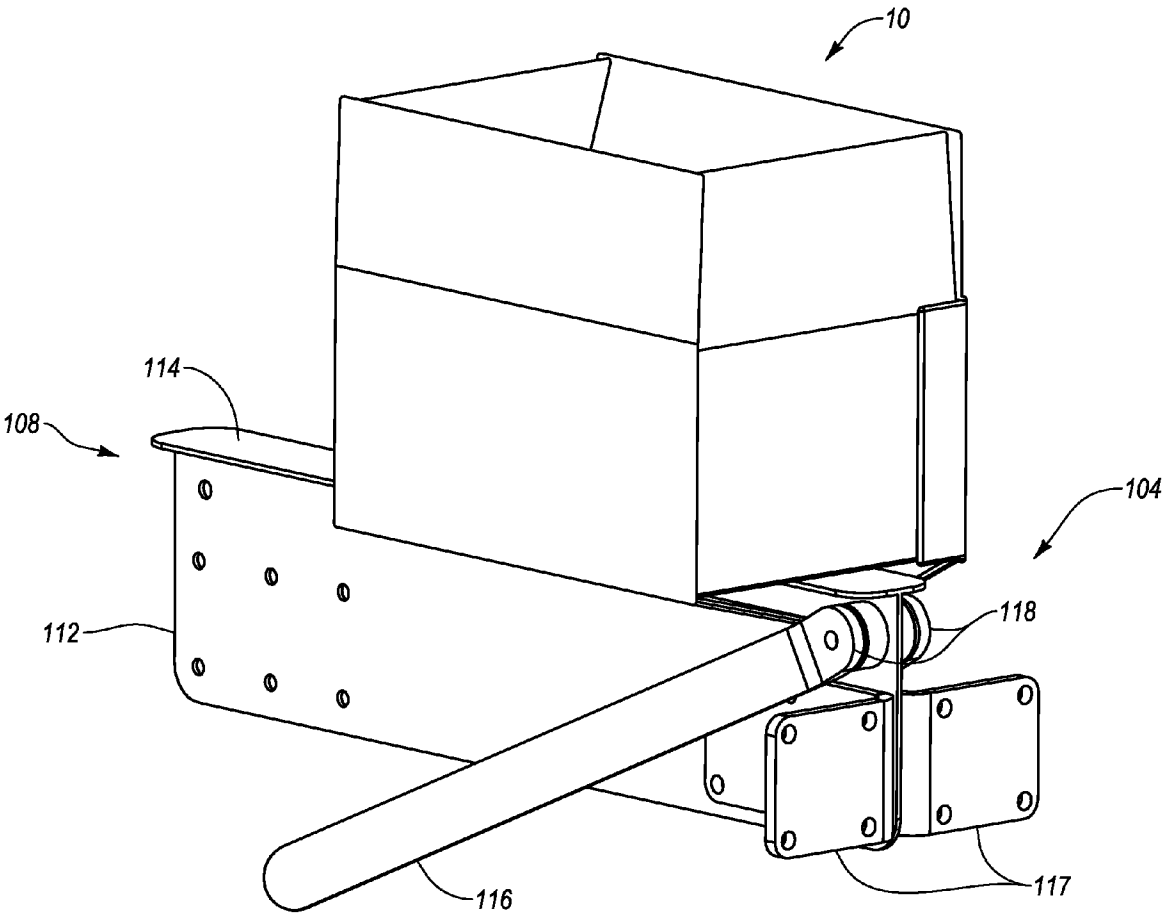
FIG. 4 illustrates an alternative embodiment of a closure assembly.
Figure 5:
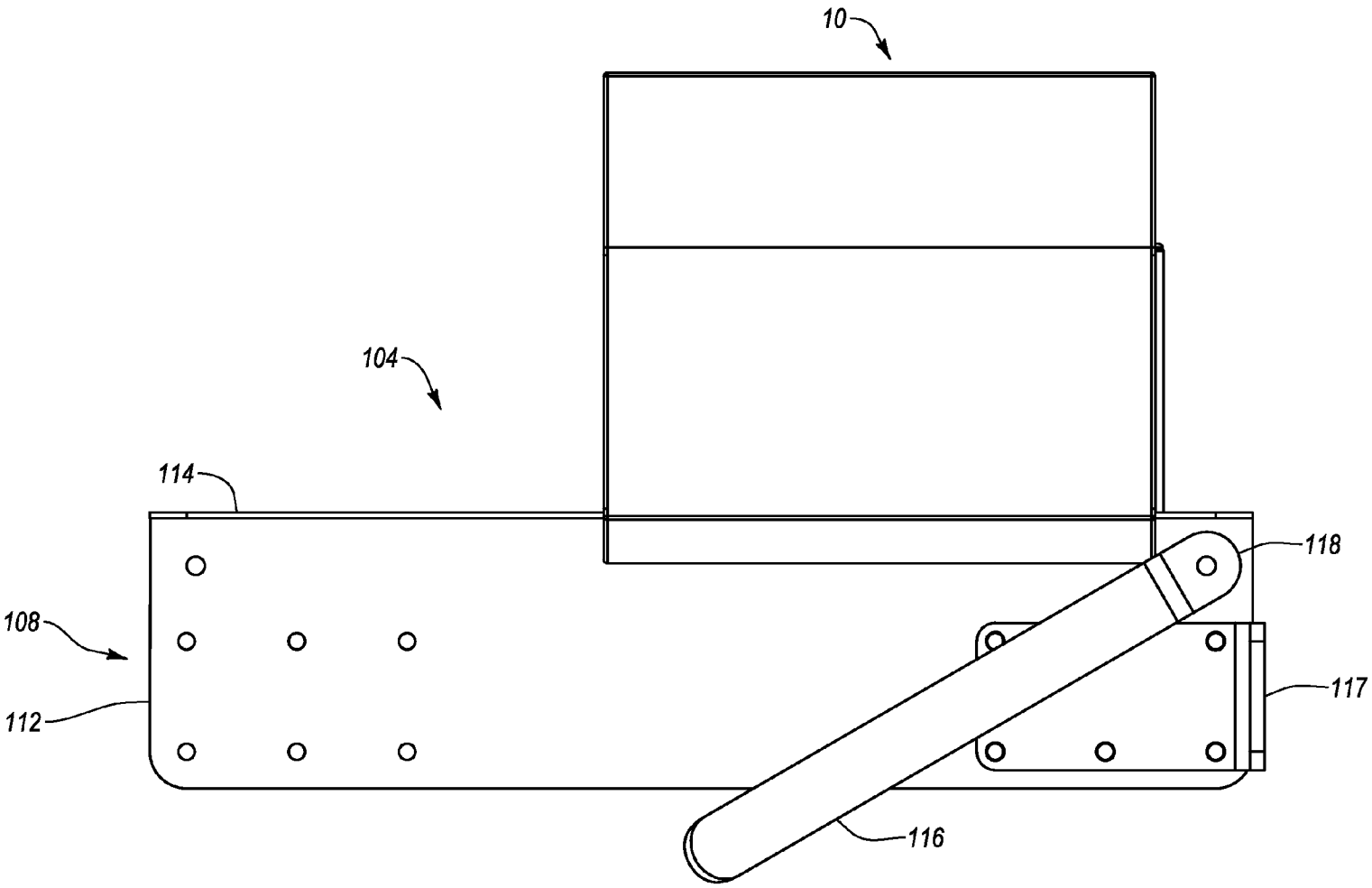
FIG. 5 illustrates another view of the closure assembly of FIG. 4.
Figure 6:
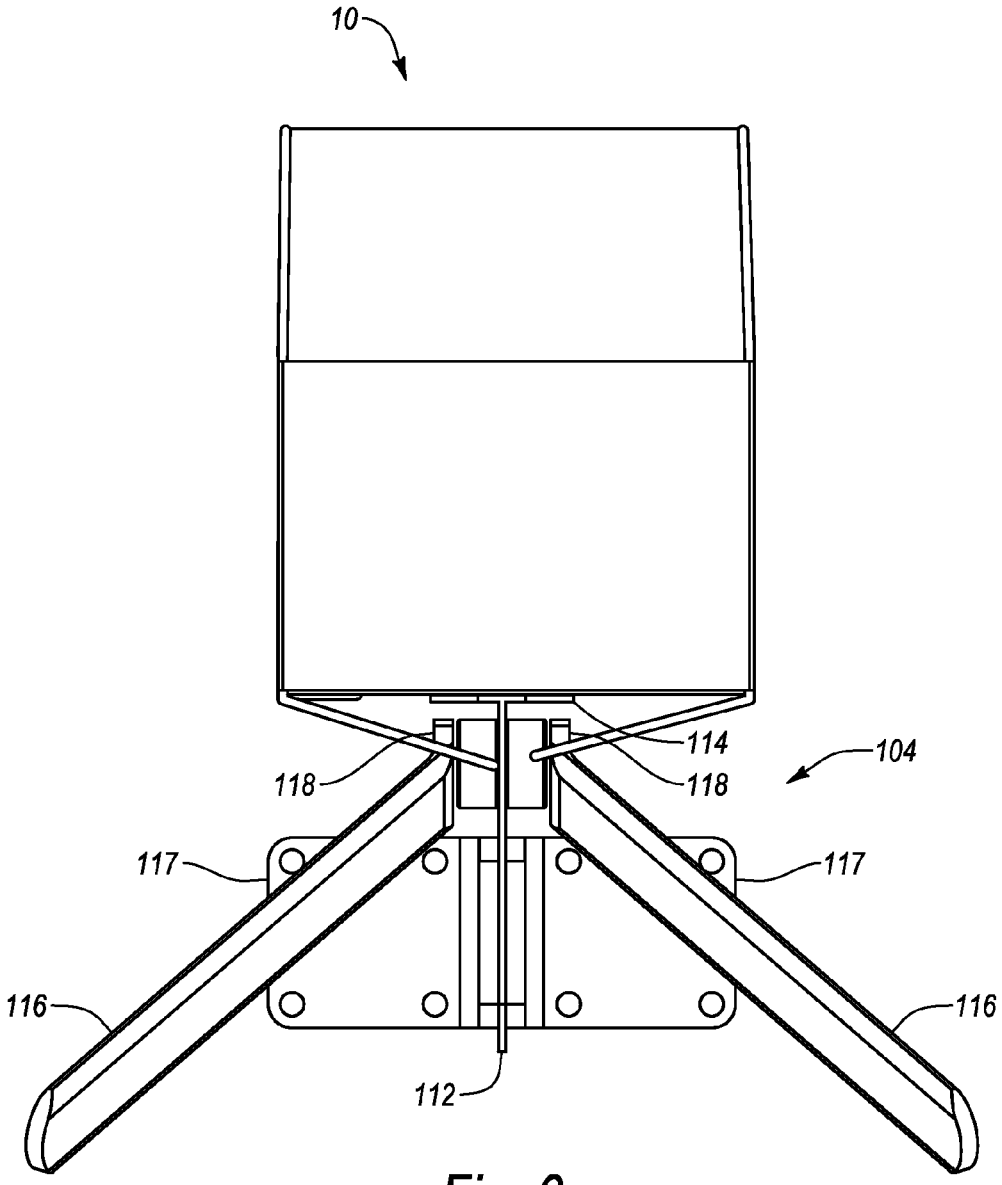
FIG. 6 illustrates another view of the closure assembly of FIG. 4.

In another example, FIGS. 4-6 illustrate guide arms 116 according to an alternative embodiment. The guide arms 116 in this embodiment are generally rectangular rods. The rods 116 are attached to the vertical portion 112 of the T-shaped structure 108 adjacent the horizontal portion 114 and the support structure 102 (not shown in this embodiment). As can be seen in the Figures, the rods 116 extend down and away from the T-shaped structure 108. This orientation allows for the major flaps to be engaged and folded closed by the rods 116. The rods 116 can be attached to the T-shaped structure 108 by way of bearings, wheels, or a spring-loaded attachment assembly 118. Such an attachment assembly 118 can enable the rods 116 to rotate slightly and/or otherwise facilitate the movement of the box through the closure assembly 104. While the rods 116 are illustrated as being generally rectangular rods, it will be appreciated that the rods 116 can be formed in any suitable shape that allows the major flaps to relatively easily slide therealong. The rods 116 can be formed of plastics, metals, composites, ceramics, and the like. Furthermore, the rods 116 are not limited to shafts, bars, and the like. Rather, the rods 116 can also include wheels, rollers, belts and the like.

With continuing reference to FIGS. 4-6, the T-shaped structure 108 includes a bolt plate 117 disposed at the proximal end of the vertical portion. The bolt plate 117 can be used to optionally attach the closure assembly 104 to a support structure (e.g., a support table or a vertical support such as a vertical beam). The closure device 104 shown in FIGS. 4-6 is an example of a closure device that can be used to close the major flaps of a box 10 without necessarily needing an extended horizontal support structure (e.g., support 106 in FIGS. 2 and 3).

Returning attention to the embodiment illustrated in FIGS. 2 and 3, it can be seen that the horizontal portion 114 of the T-shaped structure 108 is positioned slightly higher than the support surface 106. This relative positioning creates a gap 134 between the horizontal portion 114 of the T-shaped structure 108 and the top of the support surface 106. The gap 134 is sized and configured to allow the major flaps to slide therethrough as the box is moved over the T-shaped structure 108 onto the support surface 106. As such, the major flaps of the box may be secured between the first horizontal surface 114 and the support surface 106 to maintain the box in a generally closed position.

Alternatively, the T-shaped structure 108 may include a second horizontal surface 135 spaced apart and below the first horizontal surface 114 to allow the major flaps of the box to move therebetween. The separation of the first horizontal surface 114 and the second horizontal surface 135 creates a gap configured to allow the major flaps of the box to move therebetween. As such, the first and second horizontal surfaces 114 and 116 may be adapted to receive at least a portion of the major flaps therebetween to maintain the box in a generally closed position.

In some embodiments, such as shown in FIGS. 2 and 3, the T-shaped structure 108 can extend into the support structure 106. In this embodiment, the horizontal portion 114 of the T-shaped structure 108 is positioned vertically above the support surface 106. As described above, the part of the horizontal portion 114 that is positioned over the support surface 106 can act as a box hold-down device to maintain the box in a generally closed position. Typically, the major and minor flaps of a box must be securely closed, such as with glue or tape, or held closed until the box is filled, after which it can be securely closed. If the major and minor flaps are not secured or held closed, the flaps will likely unfold, allowing the box to collapse. The horizontal portion 114 that acts as the box hold-down device allows the bottom of the box to be folded closed and the box filled prior to sealing the flaps.

Figure 7:
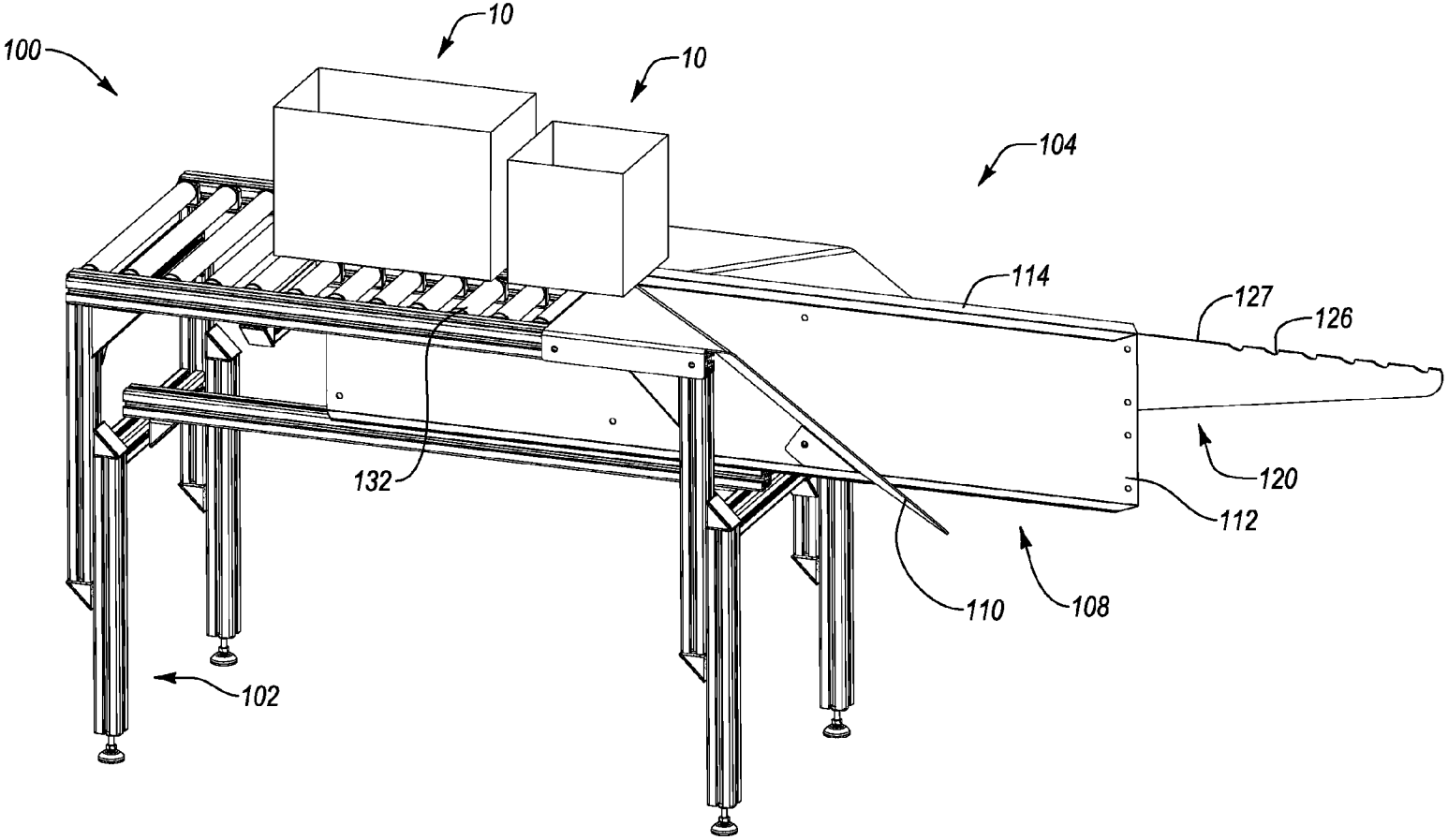
FIG. 7 illustrates a closure device similar to that of FIG. 1, with the addition of a minor flap closure device attached thereto.

Specifically, once the box has been moved through the closure assembly 104 and onto the support surface 106, the edges of the major flaps can remain under the horizontal portion 114 of the T-shaped structure 108, which will hold the box in place without the assistance of the user. While the box is held in this position, the user or a machine can fill the box with desired items. FIG. 7, for example, illustrates boxes 10 positioned on the support surface with their bottom major flaps engaging the horizontal portion 114 of the T-shaped structure 108 and the support surface 106. Once the box has been filled, the box can be sealed with tape or glue as described below.

In yet another exemplary embodiment, the horizontal portion 114 of the T-shaped structure 108 is positioned at generally the same level as the support surface 106. In this embodiment, however, the horizontal portion 114 of the T-shaped structure 108 does not extend over or to the edge of the support surface 106. Rather, the horizontal portion 114 of the T-shaped structure 108 ends prior to the edge of the support surface 106, thereby creating the gap between the T-shaped structure 108 and the support surface 106 through which the major flaps can pass.

With regard to the above discussed embodiments, it was noted that prior to folding the major flaps with the guide plate 110, a user can fold the minor flaps by hand. It will be appreciated, however, that the closure device described herein can be adapted to also fold the minor flaps of a box. For example, FIGS. 7-8E illustrate exemplary embodiments of a minor flap closure device according to the present invention.

With specific reference to FIG. 7, the minor flap closure device 120 extends from the vertical portion 112 of the T-shaped structure 108 at the end distant from the support structure 102. As can be seen, the minor flap closure device 120 is generally in the shape of a blade having a series of notches 126. The minor flap closure device 120 has a top surface 127 that generally lies in the same plane as or is parallel to the horizontal portion 114 of the T-shaped structure 108. The top surface 127 of the minor flap closure device 120 also includes one or more notches 126 therein to assist in folding one or both of the minor flaps of a box 10. For example, a user can use the minor flap closure device 120 to fold the minor flaps of a box 10 by opening the box 10 so that it is in the form of a generally rectangular tube. The user can then position the box above the T-shaped structure 108 and/or the minor flap closure device 120. The box 10 is tilted slightly forward so that the leading minor flap is slightly closer to the device than the rear minor flap. With the box 10 so oriented, the box 10 is lowered onto the top of T-shaped structure 108 or the minor flap closure device 120. Because the box 10 is slightly tilted forward, lowering of the box 10 onto the T-shaped structure 108 or the minor flap closure device 120 will cause the leading minor flap to fold toward the center of the box 10. The box 10 is then moved across the top of the T-shaped structure 108 and the minor flap closure device 120 in a direction away from the support structure 102. As the box 10 moves across the minor flap closure device, the rear minor flap will engage one of the notches 126 in the minor flap closure device 120. As the box continues to move in this direction, the notch 126 will cause the rear flap to rotate and fold toward the center of the box 10. With both minor flaps folded in, the major flaps can be folded in as described above.

FIGS. 8A-8E illustrate a closure device with an alternative minor flap closure device. Specifically, the end of the T-shaped structure 108 distant from the frame 102 includes an upwardly extending portion 122. While FIGS. 8A-8E illustrate and the upwardly extending portion 122 having an arched configuration; one will appreciate, however, that other configurations are possible so long as the upwardly extending portion 122 rises above the first horizontal surface to urge the distal major flap to a closed position as the box 10 is moved distally. At the top of the upwardly extending portion 122 is a horizontal crossbar 124 that can be used as a handle for moving the device 100 or to assist in the closure of the minor flaps.

The upwardly extending portion 122 can be used to close the minor flaps of the box in a similar manner to than described above with regard to the minor flap closure device 120. Specifically, with the box held over the T-shaped structure 108 so that the minor flaps are directly over the top thereof, a user tilts the box 10 slightly forward towards the support structure 102 of the closure device 100. The box is then lowered onto the T-shaped structure 108. As the box is lowered, the front minor flap (the minor flap closest to the support structure 102) engages the top of the T-shaped structure 108. Continuing to lower the box onto the T-shaped structure 108 forces the front minor flap to be folded toward the center of the box. The box is then tilted back toward a more horizontal position and moved horizontally towards the upwardly extending portion 122 of the T-shaped structure 108. As the box is moved in this direction, the rear minor flap (the minor flap furthest from the support structure 102) engages the upwardly extending portion 122, which urges the rear minor flap to a folded position toward the center of the box.

With continuing reference to FIGS. 8A-8E, the manner in which the device 100 is used to erect and close a box will be described. While FIGS. 8A-8E illustrate alternative embodiments of a closure device, it will be apparent from the Figures and this discussion that the manner of erecting and closing a box with the devices of the different embodiments is similar.

To use the closure device 100, a user retrieves a box blank and opens the box blanks so that it forms a generally rectangular shaped tube. The user may then fold in the minor flaps on the bottom of the box blank by hand or with the help of a minor flap closure device. For example, the minor flaps of the box 10 depicted in FIG. 8A can be closed by lowering the first minor flap onto the horizontal surface 114 of the T-shaped structure 108 at an angle. The box 10 can then be moved distally toward the upwardly extending portion 122 such that the upwardly extending portion 122 can close the second minor flap.

With the minor flaps folded closed, the major flaps can then be closed. This is accomplished by positioning the box blank on top of the horizontal portion 114 of the T-shaped structure 108 with the major flaps hanging over the sides of the T-shaped structure (FIG. 8A). The box is then moved towards the frame 102 of the closure device 100 so that the major flaps engage the guides 110 on the sides of the T-shaped structure 108. As can be seen in the Figures, the guides 110 are angled relative to the horizontal surface 114 and the vertical portion 112 of the T-shaped structure 108. This angled configuration of the guides 110 causes the major flaps to fold towards the center of the box as the box is moved along the T-shaped structure 108 towards the frame 102, as seen in FIGS. 8A-8B (see also FIGS. 4-6).

With the major and minor flaps folded closed, the box can then be sealed. As noted herein, the support structure 102 has a support surface 106 that is adapted to support a box thereon as the box moves over a sealing device 130. The support surface 106 can also include an advancement mechanism 132 that facilitates movement and proper positioning of the box on the support surface so that a sealant, such as tape, can be applied to the proper parts of the box. In some embodiments, the advancement mechanism 132 comprises at least two parallel sets of rollers, wheels, or conveyor belts. The advancement mechanism 132 is adapted to rotate about an axis transverse the direction of movement of the box. In other words, the advancement mechanism 132 is adapted to rotate so as to advance the box along the support surface 106 over the sealing device 130. The advancement mechanism 132 can further be adapted to assist in maintaining the orientation of the box as the box moves over the support surface 106. In some embodiments, this is achieved by forming the advancement mechanism 132 with a non-slip material, such as plastic or rubber, on an outer surface thereof. Thus, the advancement mechanism 132 can assist in moving the box and maintaining its orientation so that a sealant applied to the box is applied to the desired parts of the box.

The sealing device 130 mounted to the frame 102 is disposed in the middle of the advancement mechanism 132 so that a sealant can be applied to the major flaps of the box being transported over the support surface 106. In the illustrated embodiment, the sealing device 130 is a taping head that includes first and second tape guides 140 and 142, which define a tape path, and applies tape from a supply roll 144 to the box 10. The taping head 130 also includes side wall panels for retaining the rollers and other components which aid in applying the tape. Taping heads are well known in the art. Examples of such taping heads are described in U.S. Pat. Nos. 3,915,786, 3,954,550, 4,238,269, and 5,626,708, which are incorporated herein by reference in their entireties.

The taping head 130 is mounted to the support structure 102 in a secure and easily removable manner. As illustrated in the Figures, the support structure 102 and support surface 106 have a slot extending through the middle portions thereof which receive the taping head 130 therein. The taping head can be held in the slot by any suitable means. For example, the taping head 130 can be secured within the slot with a mechanical fastener, such as clamps or screws, a friction fit, or by gravity.

The supply roll 144 on the lower taping head 130 can be mounted directly on the head 130 as illustrated in the Figures. The supply roll 144 of tape can be mounted on the taping head 130 at a position at which the amount of tape on the roll 144 is easily viewable. In particular, the supply roll 144 of tape can be mounted to hang below the taping head 130 such that the supply roll can be easily seen underneath the support surface 106 and between the legs of the support structure 102. It will be understood, however, that mounting the roll of tape at other positions that are not underneath the support surface are within the scope of the present invention.

Tape from the supply roll 144 extends up to the taping head and to a first tape guide 140 of the taping head 130. As can be seem in FIG. 8B, the first tape guide 140 is adapted to engage the box 10 as the box begins to move across the horizontal portion 114 and onto the support surface 106. The first tape guide 140 is also adapted to apply the tape to the leading vertical wall of the box 10.

Figure 8C:
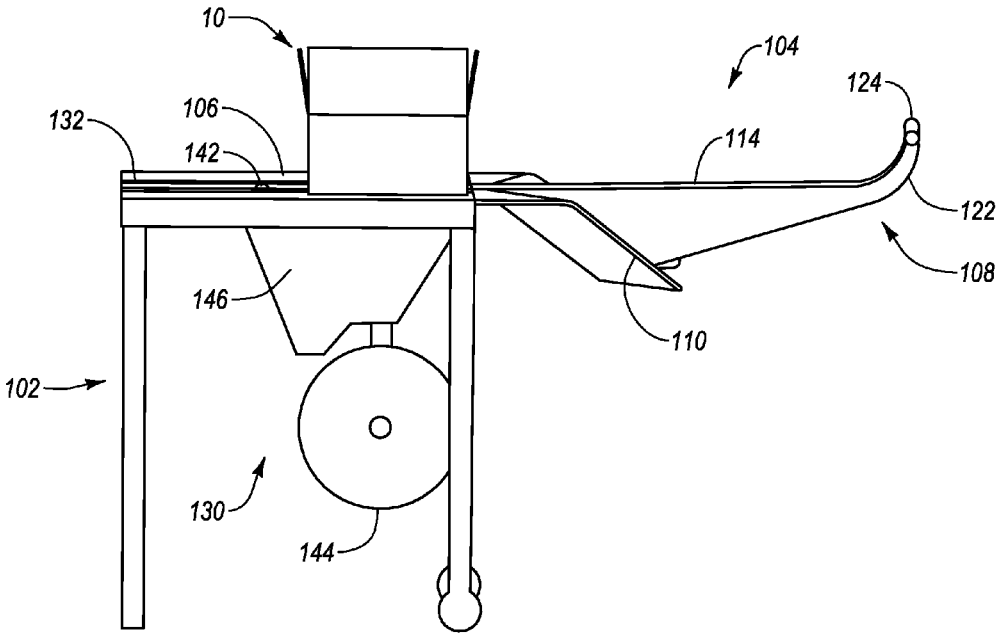
Figure 8D:
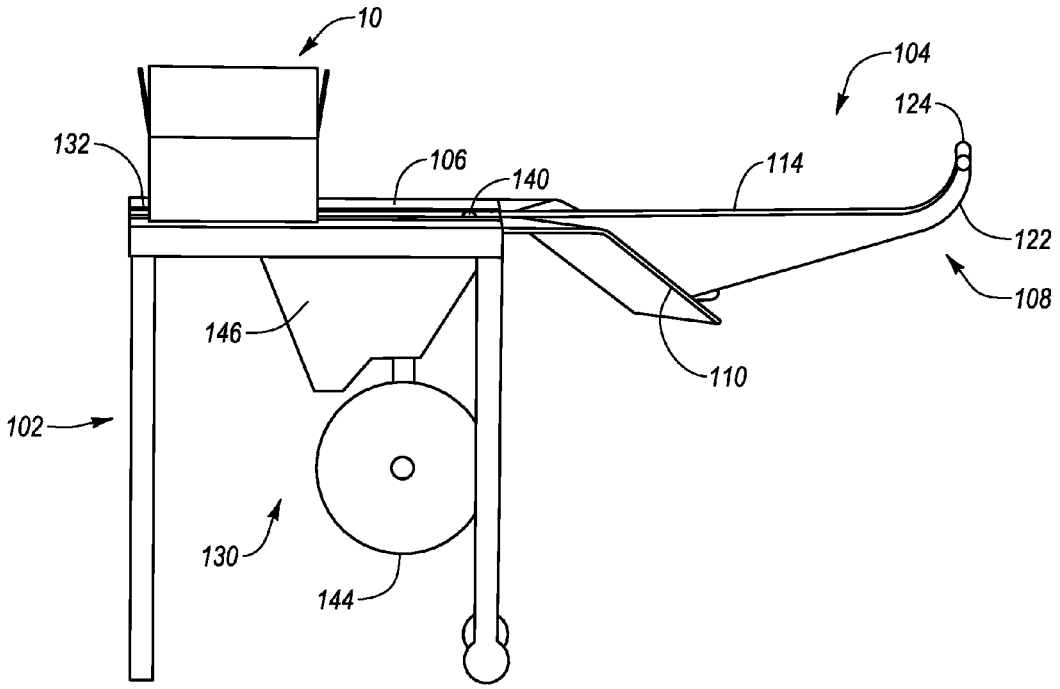
Figure 8E:
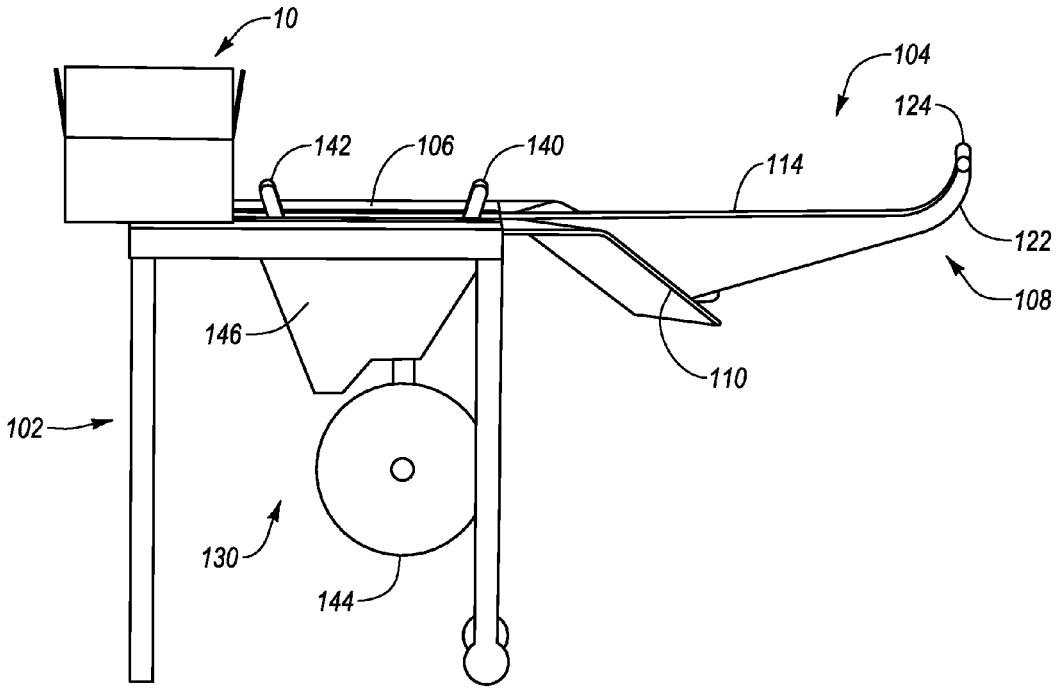

As can be seen in FIG. 8C, as the box 10 continues to moves across the support surface 106, the first tape guide 140 of the taping head 130 rotates in the same direction as the box's movement until it is positioned below the support surface. At the same time the first tape guide 140 rotates below the support surface, the second tape guide 142 of the taping head 130, which is disposed at the opposite end of the support surface 106, rotates towards the box until it is also positioned below the support surface 106. As the box continues to move forward as seen in FIGS. 8C and 8D, the first tape guide 140 applies tape to the major flaps on the bottom surface of the box 10.

As seen in FIG. 8E, as the box 10 moves past the second tape guide 142, the second tape guide 142 rotates back above the support surface 106 and applies the tape to the trailing vertical wall of the box 10. The taping head 130 also includes a cutting mechanism (not shown) that is adapted to cut the second end of tape so that it can be applied to the trailing vertical wall of the box.

While various features of the present invention have been described and illustrated herein, including the guide plates, the T-shaped structure, the minor flap closure device, the advancement mechanism, and the sealing device, it will be appreciated that the present invention can be configured with or without these various features. Additionally, the present invention can be configured with any combination of these features without departing from the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A closure device for closing flaps of a box, the closure device comprising:

a closure assembly, comprising:

a T-shaped structure having a distal end, a proximal end, and a first horizontal surface upon which a box can move during a closure process, the first horizontal surface of the T-shaped structure being configured to close a first minor flap of the box;

a guide positioned on each side of the T-shaped structure, each guide being angled relative to the T-shaped structure and adapted to close major flaps of the box as the box is moved proximally across the T-shaped structure; and a minor flap closure device comprising at least one of:

an upwardly extending portion linked to the distal end of the T-shaped structure, the upwardly extending portion being configured to close a second minor flap of the box; and a notched portion extending distally from the T-shaped structure, the notched portion being configured to close a second minor flap of the box.

2. The closure device of claim 1, further comprising a support structure linked to the closure assembly, the support structure having a support surface thereon upon which a box can be moved.

3. The closure device of claim 2, wherein the support structure comprises a table.

4. The closure device of claim 2, wherein the first horizontal surface of the T-shaped structure and the support surface are vertically spaced apart from one another to allow the major flaps of the box to move below the first horizontal surface and above the support surface.

5. The closure device of claim 1, wherein the T-shaped structure includes a second horizontal surface spaced apart and below the first horizontal surface to allow the major flaps of the box to move therebetween.

6. The closure device of claim 5, wherein the first and second horizontal surfaces are adapted to receive at least a portion of the major flaps therebetween to maintain the box in a generally closed position.

7. The closure device of claim 2, wherein the first horizontal surface of the T-shaped structure extends over at least a portion of the support surface of the support structure.

8. The closure device of claim 1, wherein the minor flap closure device further comprises a horizontal crossbar attached to the upwardly extending portion.

9. The closure device of claim 1, wherein the guides are connected to the T-shaped structure with a rotatable attachment assembly.

10. The closure device of claim 2, further comprising an advancement mechanism mounted to the support surface and adapted to facilitate alignment and movement of the box on the support surface.

11. The closure device of claim 10, wherein the advancement mechanism comprises wheels, rollers, belts, or a combination thereof.

12. The closure device of claim 11, wherein the wheels, rollers, or belts are formed of a non-slip material.

13. The closure device of claim 1, further comprising a sealing device adapted to apply a sealant to the box to maintain the major and minor flaps in a closed position.

14. The closure device of claim 13, wherein the sealing device comprises a taping head.

15. The closure device of claim 14, wherein the taping head comprises a plurality of rollers and a supply roll of tape.

16. The closure device of claim 14, wherein the taping head is mounted in a slot in the support surface.

17. The closure device of claim 16, wherein the advancement mechanism is disposed on opposing sides of the slot in the support surface.

18. The closure device of claim 1, wherein the guides extend toward the distal end of the T-shaped structure and are angled downward relative to the first horizontal surface.

19. The closure device of claim 1, wherein the guides comprise low friction plastic or metal.

20. The closure device of claim 1, wherein the guides comprise wheels, rollers, rods, shafts, generally planar sheets, or a combination thereof.

21. A method for closing and sealing at least one end of a box, comprising:

providing a closure device, including:

a T-shaped structure having a first horizontal surface upon which a box can move during a closure process;

a guide positioned on each side of the T-shaped structure; and a minor flap closure device comprising at least one of:

an upwardly extending portion linked to the distal end of the T-shaped structure; and a notched portion extending distally from the T-shaped structure;

providing a box that includes at least a pair of bottom minor flaps and a pair of bottom major flaps;

folding a first bottom minor flap of the pair of bottom minor flaps to a closed position using the minor flap closure device;

moving the box across the first horizontal surface of the T-shaped structure so that bottom major flaps of the box are folded to a closed position by the guides; and moving the box across a sealing device associated with the T-shaped structure to apply a sealant to the bottom major flaps and/or the sides of the box to secure the bottom major flaps in the closed position.

22. The method of claim 21, further comprising folding a second bottom minor flap of the pair of bottom minor flaps to a closed position using the T-shaped structure.

23. The method of claim 22, wherein the minor flap closure device further comprises a horizontal crossbar attached to the upwardly extending portion.

24. The method of claim 22, wherein the guides are connected to the T-shaped structure with a rotatable attachment assembly.

25. The method of claim 21, further comprising closing and sealing a top of the box.

26. The method of claim 25, wherein closing and sealing the top of the box comprises:

folding top minor flaps of the box to a closed position;

inverting the box;

moving the box across the top of the T-shaped structure so that top major flaps of the box are folded to a closed position by the guides; and moving the box across the sealing device associated with the T-shaped structure to apply a sealant to the top major flaps and/or the sides of the box to secure the top major flaps in a closed position.

27. A closure device for closing flaps of a box, the closure device comprising:

a support structure having a substantially horizontal support surface upon which a box can be moved; and a closure assembly linked to one end of the support structure, the closure assembly comprising:

a T-shaped structure having a distal end, a proximal end, and a first horizontal surface upon which a box can move during a closure process, the first horizontal surface of the T-shaped structure being configured to close a first minor flap of the box, the first horizontal surface of the T-shaped structure and the support surface of the support structure being vertically spaced apart from one another to allow the major flaps of the box to move therebetween;

a guide positioned on each side of the T-shaped structure, each guide being angled relative to the T-shaped structure and adapted to close major flaps of the box as the box is moved proximally across the T-shaped structure; and a minor flap closure device comprising at least one of:

an upwardly extending portion linked to the distal end of the T-shaped structure, the upwardly extending portion being configured to close a second minor flap of the box; and a notched portion extending distally from the T-shaped structure, the notched portion being configured to close a second minor flap of the box.

28. The closure device of claim 27, wherein the T-shaped structure includes a second horizontal surface adapted to receive at least a portion of the major flaps between the first and second horizontal surfaces to maintain the box in a generally closed position prior to sealing of the box.

29. The closure device of claim 27, wherein the closure device further comprises a sealing device adapted to apply a sealant to the box to maintain the flaps of the box in the closed position.

30. The closure device of claim 27, wherein the first horizontal surface of the T-shaped structure extends over at least a portion of the support surface of the support structure.

31. The closure device of claim 30, wherein the minor flap closure device further comprises a horizontal crossbar attached to the upwardly extending portion.

32. The closure device of claim 27, wherein the guides are connected to the T-shaped structure with a rotatable attachment assembly.

33. The closure device of claim 29, wherein the sealing device comprises a tape head.

34. The closure device of claim 33, wherein the taping head comprises a plurality of rollers and a supply roll of tape.

35. The closure device of claim 33, wherein the taping head is mounted in a slot in the support surface.

36. The closure device of claim 27, wherein the guides extend toward the distal end of the T-shaped structure and are angled downward relative to the substantially horizontal support surface of the support structure.

* * * * *